United States Patent [19]

Stavros et al.

[11] 4,339,480

[45] Jul. 13, 1982

[54] GAS WIPING APPARATUS AND METHOD OF USING

[75] Inventors: Anthony J. Stavros; Roger L. Crandall, both of Bethlehem, Pa.

[73] Assignee: Bethlehem Steel Corporation, Bethlehem, Pa.

[21] Appl. No.: 249,513

[22] Filed: Mar. 31, 1981

Related U.S. Application Data

[63] Continuation-in-part of Ser. No. 139,606, Apr. 11, 1980.

[51] Int. Cl.[3] ..... C23C 1/00; B05C 11/06

[52] U.S. Cl. ..... 427/349; 427/433; 427/432; 118/63; 118/420

[58] Field of Search ..... 427/367, 347, 432, 348, 427/349, 433; 118/63, 420, 422; 15/306 A

[56] References Cited

U.S. PATENT DOCUMENTS

| | | | |
|---|---|---|---|
| 2,194,565 | 3/1940 | Moss | 118/63 |
| 3,060,889 | 10/1962 | Knapp | 118/63 |
| 3,270,364 | 9/1966 | Steele | 15/306 |
| 3,523,815 | 8/1970 | Baxter | 427/349 |
| 3,533,761 | 10/1970 | Pierson | 427/349 |
| 3,611,986 | 10/1971 | Pierson | 118/63 |
| 3,707,400 | 12/1972 | Harvey et al. | 427/349 |
| 3,736,174 | 5/1973 | Moyer | 427/349 |

*Primary Examiner*—Ralph S. Kendall

*Attorney, Agent, or Firm*—Joseph J. O'Keefe; Charles A. Wilkinson

[57] ABSTRACT

A gas wiping die for wiping wire issuing from a molten metal coating bath is provided with critical parameters with respect to the die angle, the length and thickness of the die orifice and the relationship of the sides of the orifice, the throat diameter of the die and the height above the molten bath surface. The thickness of molten coatings on wire wiped with the combined die can be very accurately controlled by changes in wiping gas pressure.

25 Claims, 4 Drawing Figures

GAS WIPING APPARATUS AND METHOD OF USING

CROSS REFERENCE TO RELATED APPLICATIONS

This application is a continuation-in-part of U.S. application Ser. No. 139,606 filed Apr. 11, 1980 entitled "Gas Wiping Apparatus and Method of Using".

BACKGROUND OF THE INVENTION

This invention relates to the coating of narrow linear material such as strip, and especially wire, with metal coatings in a molten metal coating bath. More particularly the invention relates to the combined use of protective atmospheres and gas wiping in treating linear material issuing from a molten metal coating bath in order to establish an accurate and uniform thickness of coating on the surface of the linear material.

Metallic linear material such as strip and wire have been economically coated for many years by passing the linear material through a bath of molten metal, such as molten zinc or aluminum. Usually the linear material has been a ferrous material, such as steel or the like. The coating of aluminum or zinc or sometimes other metals or alloys, such as tin or terne (an alloy of lead with up to 25% tin), provides corrosion resistance to the underlying ferrous metal.

Linear material issuing from a molten metal coating bath usually does not have a satisfactory layer of molten coating metal on its surface. The molten metal coating is invariably either too thick, too uneven, or both, or has some other defect which would prevent the molten metal from solidifying into a satisfactory metal coating upon the substrate metal. As a consequence, it has been customary to wipe the coating in some manner after the linear material leaves the molten coating bath in order to smooth and/or reduce the weight, or thickness, of the coating. Various wiping devices have been used to wipe the coating while it is still molten including soft wipers such as asbestos wipers and the like, rigid wipers such as rolls and scrapers and occasionally semi-rigid wipers composed of layers of various materials such a charcoal or gravel through which the coated linear material passes. More recently gas wipers, or gas doctors, have been used to blow a gas such as air, steam or some inert or reducing gas forcibly against the surface of the molten metal coated linear material to remove excess metal and smooth the coating of molten metal.

In order to attain good adherence of the coating metal to the substrate metal it is necessary for the surface of the substrate to be clean prior to passage through the molten coating bath. The linear material must, therefore, be cleaned prior to being coated to provide a suitable clean, active substrate surface for contact with the molten coating bath. Once the substrate metal is clean it must be kept active, i.e. oxide free, until it is submerged in the molten coating bath. It is therefore necessary to protect the substrate metal after cleaning either with a coating of flux or else by immersion or continuous bathing in an inert or reducing atmosphere. Thus, ferrous linear material frequently enters the molten bath in a protective or oxygen excluding atmosphere of some nature. The protective atmosphere will usually be composed of either an effectively inert gas or a reducing gas or gases.

Inert or reducing atmospheres have also been maintained about the linear material as it exits from the molten bath to prevent excessive or otherwise detrimental oxidation of the surface of the coating while it is still hot, both before and after the coating solidifies. The protective atmosphere is usually contained in a protective chamber, or hood, of some form which extends to or into the surface of the molten bath.

With the more recent frequent use of gas wipers for smoothing and wiping the molten coating, the use of an inert or more frequently a reducing gas to wipe the surface of the linear material has sometimes been adopted to prevent surface oxidation of the coating metal. In some installations, and particularly in wire wiping installations, the wiper has been enclosed in or attached to a chamber containing a protective atmosphere so that the molten coating on the wire is completely protected from exposure to the atmosphere until it is smoothed and wiped.

The use of a non-oxidizing gas as both a wiping and a protective gas has been found to be particularly desirable in the wiping of wire material. Otherwise, oxidized coating particles on the molten coating surface tend to increase the viscosity of the molten metal and result in buildup of a thick viscous oxide coating layer which seriously interferes with effective gas wiping. The small circumference of the wire allows viscous rings of oxide material to form about the wire and break through the gas barrier resulting in thick rings of coating on the wire, which rings crack and flake when the wire is bent after solidification of the coating.

One problem which has been encountered in such combined wiping and protective gas installations as, for example, that illustrated in U.S. Pat. No. 3,707,400, which discloses a combination of a closed hood, containing an inert gas, and a wiping die, that may use the same inert gas as a wiping gas, has been a tendency of the wiping die to provide very poor control of the thickness of the final coating if only the force of the wiping gas is depended upon to establish the thickness of the coating. This has been so in spite of the fact that such combined wiping and protective gas arrangements very efficiently and effectively wipe excess coating from and smooth linear material such as wire passing through the die. However, the exact final thickness of coating has been impossible to control without varying the parameters of the wiping die itself. In other words, while the smoothing of the coating is very effective and a large excess of coating material can be removed from the coated material, actual dimensional control of the coating thickness by the wiping gas has not been satisfactory. It has thus been necessary in many cases to vary the velocity of passage of the linear material through the wiping die in order to effectively control the degree of wiping of molten coating from the surface of the linear material. If the molten coating layer is too thick, it has been necessary to decrease the speed of passage of the linear material through the die orifice in order to decrease the coating layer. If the coating layer is too thin, on the other hand, it has been necessary to increase the speed of the linear material through the die orifice in order to increase the thickness. Naturally, the necessity to adjust the speed of the coating line in order to attain a desired coating weight is undesirable, because such adjustment interferes with other operational and production considerations.

A further problem with prior wiping apparatus and methods particularly in the coating of wire material has been poor concentricity of the final coating with the wire. In a "concentric coating" the coating thickness is substantially equal on all sides of the wire or all around the wire. In a non-concentric coating the thickness of the coating on one or more side of the wire is significantly thicker than the thickness of the coating on the diametrically opposite side or sides. The coating may be concentric on portions of the wire and non-concentric on adjoining portions of the wire. Usually the concentricity varies in a more or less random manner along any given length of wire. In fact it is substantially impossible to obtain a substantial length of perfectly concentric hot dip coated wire particularly with prior known apparatus.

The importance of concentricity is really the avoidance of thin spots in the coating and it will be evident that thin spots may occur because of other factors such as out-of-round or oval coating deposits or the like as well as true non-concentricity. One measure of concentricity then is the number of thin spots in a coating, it being realized that complete concentricity or absence of thin spots is substantially impossible in hot dip coating of wire. It has been the experience of the present inventors that in a hot dipped aluminum-zinc coating, for example, the best or most concentric wire coating which could be obtained using prior gas wipers—based upon an aim coating of 1.5 mils, or thousands of an inch, (i.e. 0.38 millimeter) and with a thin spot defined as any coating area of less than 0.5 mil (0.0127 millimeters) as measured by a commercial type non-destructive spot coating weight detector—would have over 2.5% of the measurements on any given length of wire below 0.5 mil (0.0127 millimeters). In other words, with a thin spot being defined as approximately one third of the aimed for or desired coating thickness, an average of over 2.5% of all tested spots on any given length of wire will turn out to be thin spots, or below minimum in thickness. While this number of thin spots is quite acceptable for most purposes, especially in a sacrificial coating, such as, for example, zinc or aluminum-zinc on a ferrous base material, it does represent a waste of coating metal since somewhat thicker coatings must be used on all portions of the wire to prevent an excess number of unacceptably thin spots.

SUMMARY OF THE INVENTION

The disadvantages of prior combinations of gas wiping dies and protective hoods for wiping wire have now been obviated by the improvement of the present invention. It has been discovered that the use of critical die parameters permits the gas wiper to effectively determine the weight of coating remaining on the final coated wire without regard to the speed of passage of the wire through the wiper die and also without regard to the presence or absence of a protective chamber or hood in association with the wiping die. The critical die parameters are an orifice angle downwardly of about 10 to 45 degrees and preferably 15 to 30 degrees with respect to perpendicular to the surface of the wire material passing through the die, an orifice width parallel with the direction of movement of the wire through the die of about 0.010 to 0.080 inch (0.254 to 2.032 millimeters) and preferably 0.020 to 0.050 inch (0.508 to 1.27 millimeters), substantially parallel sides on the orifice and a minimum length of the orifice along the line of passage of the wiping gas of not less than 0.25 inch (0.635 centimeter). The height of the orifice above the molten coating bath should be from 0.50 to 15 inches (1.27 to 38.1 centimeters) and preferably about 0.50 to 10 inches (1.27 to 25.4 centimeters) and most preferably 0.50 to 4 inches (1.27 to 10.16 centimeters), and the throat of the die must be not less than 0.50 inch (1.27 centimeters) up to 1.50 inches (3.81 centimeters) and preferably 0.75 to 1.25 inches (1.9 to 3.175 centimeters). A most preferable orifice angle has been found to be about 20 to 25 degrees with a most preferable orifice width of about 0.035 to 0.045 inches (0.889 to 1.043 millimeters). The height above the bath surface will depend somewhat upon the structure of the wiping die. If the die has a hood or protective gas chamber or partial protective chamber, i.e. in which the chamber walls only partially surround a space, at the lower end the die can be positioned farther from the bath surface whereas if there is no protective chamber best results are obtaind if the die is closely spaced, for example, 0.50 to 4 inches (1.27 to 10.16 centimeters) with respect to the bath surface.

DESCRIPTION OF THE PREFERRED EMBODIMENT

Figure 1:
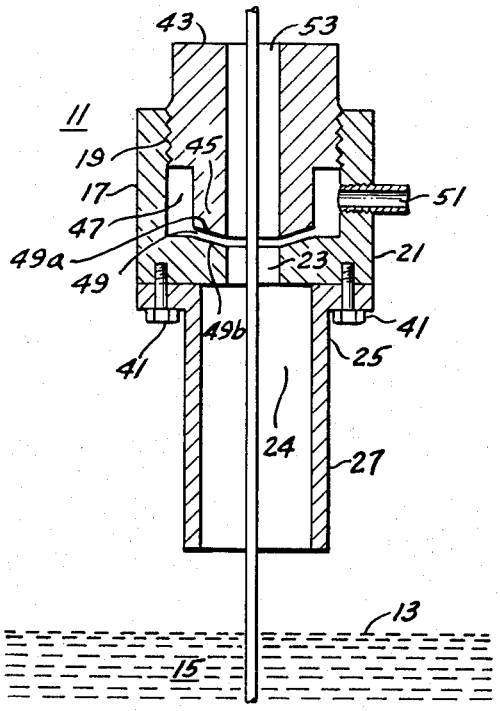
FIG. 1 shows in cross section a wire wiping arrangement in accordance with the improvement of the invention.

The present invention provides an improved gas wiping arrangement for wiping molten metal coated linear material such as wire to both smooth the coating surface and determine the coating weight or thickness. In accordance with the invention, there is provided a gas wiping die which is positioned adjacent to the surface of a molten metal coating bath. The gas wiping die may be mounted either within or closely adjacent to and connected with a hood or protective chamber which encloses the linear material as it passes from the molten metal coating bath to the gas wiping die. Alternatively the gas wiping die may be positioned close to the surface of the molten bath without a protective hood. The protective hood, if used, is supplied with an inert or effectively inert gas which serves to protect the surface of the molten coating from oxidation until it reaches the wiping die. A portion of the surface of the molten coating bath may also be enclosed within the hood to prevent or minimize the formation of an oxide film or scum upon the surface of the molten bath.

In order to have the inert or reducing gas determine or control the final weight or thickness of the final coating on the wire it has been discovered that the following criteria must be adhered to. These are:

(1) the gas wiping orifice must be inclined downwardly at an angle of about 10 to 45 degrees with respect to perpendicular to the surface of the wire and more preferably about 15 to 30 degrees from perpendicular with respect to the surface of wire passing through the die, with a most preferable angle of about 20 to 25 degrees, (2) the orifice thickness or width parallel to the wire should be between about 0.010 to 0.080 inch (0.254 to 2.032 millimeters), preferably 0.020 to 0.050 inch (0.508 to 1.27 millimeters) and most preferably 0.035 to 0.045 inch (0.889 to 1.043 millimeters), (3) the orifice must have curved sidewalls parallel to each other and equidistant at all points from the surface of the material being wiped and at least a minimum of about 0.25 inch (0.635 centimeter) in length in the direction of the flow of the gas. In general, the longer the sidewalls are within the constraints of the dimensions of the die the better, (4) the height of the die orifice must be about 0.50 to 15 inches (1.27 to 38.1 centimeters), preferably between about 0.50 to 10 inches (1.27 to 25.4 centimeters) and most preferably about 0.50 to 4 inches (1.27 to 10.16 centimeters) above the surface of the molten bath, (5) the throat diameter of the die should be not less than 0.50 inch (1.27 centimeters) nor more than 1.50 inches (3.81 centimeters) and preferably between 0.75 and 1.25 inches (1.9 to 3.175 centimeters).

Very satisfactory wiping has been obtained, as an example, with an orifice angle of 22.5 degrees, an orifice width of 0.040 inch (1.016 millimeters) and a throat diameter of 1 inch (2.54 centimeters) at between 1 to 4 inches (2.54 to 10.16 centimeters) above the bath surface. It is preferable for best results that the inert or reducing gas used as the wiping gas be a "heavy" gas. However, other non-odixizing gases can be effectively used in most cases. Suitable heavy gases are nitrogen, argon, propane and the like. The term heavy is used in contradistinction to "light" protective gases such as hydrogen ($H_2$), methane ($CH_4$), natural gas and helium. (A heavy wiping gas may be defined as a gas having a molecular weight or a density substantially the same or greater than the average molecular weight or density of air.)

It has surprisingly been found that when the above die parameters and conditions are strictly adhered to good control of the coating thickness or weight can be obtained merely by varying the pressure of the wiping gas. On the other hand, when a wiping die is used with a completely closed protective chamber into which the wiping gas is discharged, as for example in U.S. Pat. No. 3,707,400, adequate control of the coating thickness or weight cannot be attained on wire, although the coating is wiped and smoothed.

Surprisingly also it has been found that very excellent concentricity of the coating about the wire, or stated in other words, a decreased number of thin spots in the coating, can be obtained with the present invention. Using the improved wiper and method of the invention the present inventors have consistently been able to obtain aluminum-zinc coatings, for example, for which the die invention has been found to be particularly suitable, having less than 0.3% of the coating thickness measurements made with a commercial type non-destructive spot coating weight detector over any given length of wire less than 0.5 mil (0.0127 millimeter) when the aim coating was 1.5 mils (0.038 millimeter). This is an order of magnitude greater than the best previous experience of the inventors with prior gas wipers where the best results which could be attained showed more than 2.5% of the readings less than 0.5 mil (0.0127 millimeter). In other words, where a thin spot is considered to be approximately one third or less of the aimed for or desired coating thickness a wire coated in accordance with the present invention will show less than 0.3% of the spots tested over any given length as being thin.

In FIG. 1 there is shown diagrammatically in elevated cross section a gas wiping die in accordance with one embodiment of the invention. A gas wiping die 11 is positioned a predetermined distance from the surface 13 of a molten metal coating bath 15. The die per se is comprised of an outer cylindrical body 17 having internal threads 19 at the upper end within the hollow interior of the cylindrical body. The cylindrical body has a lower end 21 in which there is an orifice 23 leading into a gas passageway 24 confined within side walls 25 of a cylindrical gas directing member 27. The orifice 23 constitutes the so-called throat of the wiping die.

The cylindrical member 27 is secured to the bottom of cylindrical body 17 of the die 11 by means of removable machine bolts 41. It will be understood, however, that any other suitable connecting means such as, for example, a threaded connection or the like could be used. Alternatively, the member 27 may comprise a extension of the bottom or lower end 21 of the die 11.

The outer cylindrical body 17 of the die 11 has an inner cylinder 43 threaded into it. The inner cylinder 43 has an extension or nose 45 which, when the two cylindrical members 17 and 43 are correctly positioned with respect to each other, defines between its surface and the inner surface of the outer cylindrical body 17 an arcuate circumferential gas passageway 47. The lower portion of this passageway constitutes a circumferential gas wiping orifice 49. The central space about which the circumferential gas wiping orifice 49 extends may be considered to constitute an upward extension of the throat 23 of the gas wiping die. Wiping gas is supplied to the circumferential gas passageway 47 via a gas inlet pipe 51 which, it will be understood, is connected to a supply of pressurized wiping gas such as a tank or tanks of pressurized gas or a gas generation plant or the like through suitable intermediate pipe and an adjustable valve means or, if desired, automatic pressure control means, not shown, the details of which are known to those skilled in the art.

The gas wiping orifice 49 in accordance with the invention has straight sidewalls **49*a* and 49*b* which are parallel to each other and are inclined downwardly at an angle of 25 degrees with respect to perpendicular to the surface of the wire. The thickness of the wiping orifice in a direction parallel to the surface of the wire, i.e. the distance between the parallel sidewalls 49*a* and 49*b* is 0.040 inch (1.016 millimeters). The length of the parallel sidewalls 49*a* and 49*b* is 0.5 inches (1.27 centimeters). The distance between the inner edges of the orifices is 1 inch (2.54 centimeters). This last dimension is also the diameter of the throat 23 of the die. The distance of the gas wiping orifice 49 where such orifice communicated with the throat 23 from the surface 13 of the coating bath 15 is 4 inches (10.16 centimeters). The height of the bottom of the cylindrical member 27** above the bath surface is 1 inch (2.54 centimeters).

In operation of the apparatus shown in FIG. 1 the wire 37 passes through the molten metal coating bath in any conventional manner, usually down around a lower sinker roll, or sheave, not shown, and then up through the bath surface, up through the gas passageway 24, through the orifice or throat 23, past the cirumferential wiping gas orifice 49 and finally upwardly through the central passageway 53 of the inner cylinder and out of the gas wiper.

As the wire passes by the circumferential gas wiping orifice 49 it is wiped by a precisely dimensioned, compact curtain of gas which has been shaped by the critical dimensions of the wiping orifice. This curtain of gas wipes and smooths the molten coating on the wire. Excess coating is in effect pushed back into the molten coating bath. The gas used is preferably a reducing or inert gas and should preferably, it is presently believed, in order to attain the best control of coating weight, be a heavy gas, such as, for example, argon, nitrogen, propane or the like. This gas curtain is directed downwardly and inwardly at an angle of about 25 degrees plus or minus several degrees, toward the wire to effect the wiping action. The non-oxidizing gas passes downwardly toward the surface of the molten bath where it additionally serves to protect the molten coating on the wire and the molten surface of the bath from oxidation. Such oxidation would tend to form a coating of oxide on the surface of the bath which could then be drawn upwardly with the molten coating on the wire causing an undesirable roughness on the wire and interfering with smooth wiping of the coating. The reducing or inert gas can, since it protects the molten metal from oxidation, be referred to broadly as the protective or non-oxidizing gas.

It has been found, contrary to the situation with previous combined wiping and protective chamber gas arrangements, that when the critical parameters of the present invention are adhered to, very effective control of the coating thickness on the wire can be obtained merely by varying the pressure of the wiping gas. If the critical parameters of the die are not adhered to, however, effective wiping control by gas pressure alone is not obtained unless a critically sized exhaust orifice in the side of the protective chamber is used as disclosed in an application filed concurrently with the application upon which the present application is a continuation-in-part and assigned to the same assignee.

Figure 2:
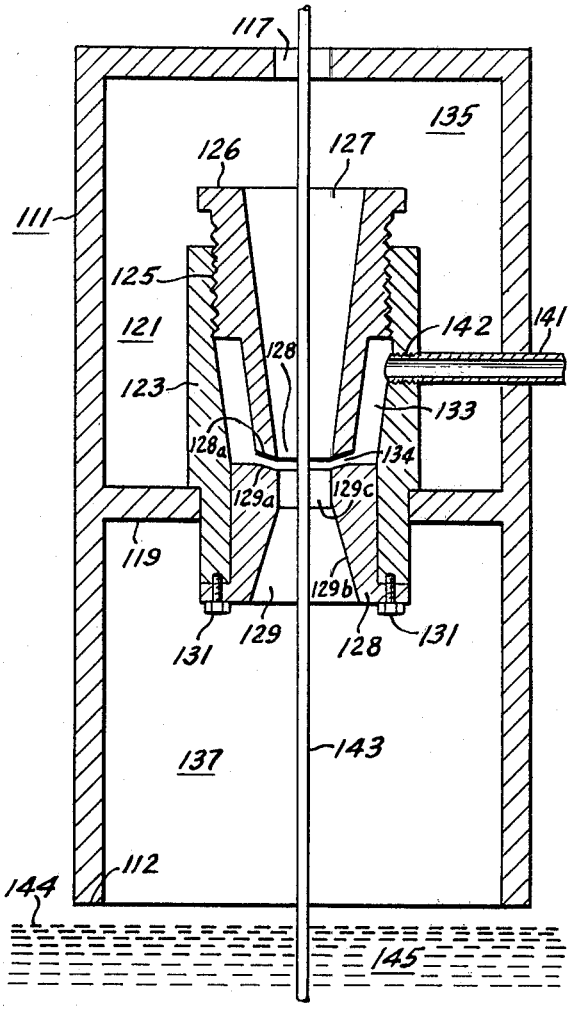
FIG. 2 shows in cross section a further form of gas wiper in accordance with the invention.

In FIG. 2 there is shown an alternative arrangement of a die and hood for the coating of wire. In the FIGURE is shown a cylindrical hood 111. The hood 111 has an exit orifice 117 in the center of the top of the hood. The hood also has a circumferential bracket 119 in the center having a central opening in which there is mounted a gas wiping die 121 comprised of an outer cylindrical body 123 having internal threads 125 into which is threaded an inner cylindrical member 126 having a central conical throat 127. A cylindrical throat member 128 having an interior passage 129 in the shape of two opposed interior conical sections **129*a* and 129*b* connected by a central cylindrical section 129*c* is positioned in the bottom of the outer cylindrical body 123 and secured in place by machine bolts 131. The cylindrical throat member is preferably made from a wear resistant material such as a hard stainless steel. An annular pasageway 133 between the outer cylindrical body 123 and the inner cylindrical member 126 is connected to a circumferential gas wiping orifice 134 which leads to the upper portion of the interior passage 129**.

The inner cylindrical member 126 has a short nose 128 which has an outer conical surface **128*a*. The conical surface 128*a* of the nose 128 is parallel to or equidistant at points from the interior conical section 129*a* and when the inner cylindrical member is threaded into the outer cylindrical body 123 the surfaces 128*a* and 129*a* form a downwardly inclined orifice having substantially parallel curved surfaces approximately 0.030 inch (0.762 centimeter) apart, the parallel or equidistant portions of each surface 128*a* and 129*a* being approximately 0.25 inch (0.635 centimeter) in length. This provides a gas wiping orifice 134 having a thickness of 0.030 inch (0.762 centimeter) and a uniform length of 0.25 inch (0.635 centimeter). The wiping orifice is inclined downwardly at an angle of 30 degrees with respect to perpendicular to the surface of the wire and the opening of the gas wiping orifice is approximately 5 inches (12.7 centimeters) above the surface 144 of the molten coating bath 145**.

The circumferential bracket 119 which supports the wiping die 121 divides the cylindrical hood 111 into an upper chamber 135 and a lower chamber 137. The upper and lower chambers 135 and 137 are not in direct communication with each other. A gas inlet pipe 141 passes through the side of the hood 111 and is threaded into an opening 142 in the outer cylindrical body 123 leading into the annular passageway 133. Alternatively there may, in order to obtain more uniform gas pressure in the annular passageway 133, be several gas inlets 141. The lower edge 112 of the hood 111 is preferably spaced a small distance above the bath surface 144. This distance may be about 0.25 to 0.50 inches (0.635 to 1.27 centimeters) but can be significantly more or less.

In operation a wire 143 passes up through a molten coating bath 145 exiting from the bath surface 144 into the lower chamber 137, thence through the wiping die 121, past the gas wiping orifice 134 where it is wiped by a curtain of inert or reducing gas issuing from the circumferential gas wiping orifice, and into the upper chamber 137 from which the wire 143 exits through the orifice 117.

At least a portion of the wiping gas after wiping and smoothing the coating on the wire as it passes through the circumferential orifice 134 passes downwardly through the interior passage 129 of the throat member 128 into the confined space of the lower chamber 137 of the hood 111 where the gas shields the molten coating on the wire and the molten surface 144 of the coating bath 145 directly under the chamber 137 from oxidation. Excess gas escapes from the chamber 137 around the lower edge. Alternatively the lower portion of chamber 137 could be submerged in the molten coating bath forming a substantially completely confined space within the chamber 137 and excess accumulated protective gas could pass back through the interior passage 129 and conical throat 127 into the upper chamber 135 where it would continue to shield the wire and finally be exhausted through the orifice 117 in the top of the hood. If the wiping and shielding gas, i.e. protective gas, is a combustible reducing gas, it is preferably burned as it passes through the orifice 117.

Figure 3:
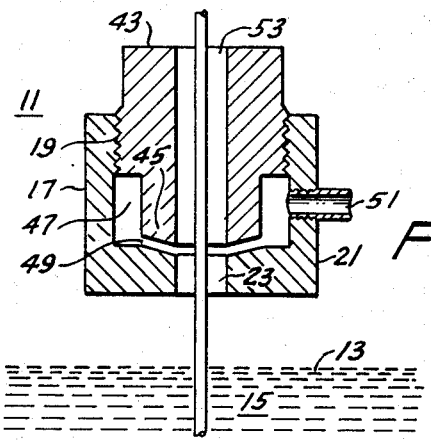
FIG. 3 shows in cross section a further form of gas wiper in accordance with the invention.

In FIG. 3 there is shown a further embodiment of the invention. In FIG. 3 there is shown a gas wiping die which is substantially identical to the wiping die shown in FIG. 1 with the exception that the cylindrical gas directing member 27 is not used on the bottom of the die. Since all the parts of the die are substantially the same as shown in FIG. 1, the same designating numerals have been used to identify the various parts in FIG. 3 as were used in FIG. 1. The die has a throat diameter of 1 inch (2.54 centimeters) and the gas wiping orifice is located 1.5 inches (3.81 centimeters) above the surface of the molten bath. The other parameters of the die are the same as the die shown in FIG. 1. A flow of nitrogen gas from the wiping orifices combined with the large throat diameter and the close positioning of the die to the surface of the molten coating bath very effectively wipes the coating on the wire and allows the coating weight to be determined merely by adjustment of the pressure of the wiping gas. The closeness of the wiping die to the surface of the molten bath and the large volumes of gas which pass through the large throat diameter allow the surface of the coating on the portion of wire between the surface of the coating bath and the wiping die and part of the surface of the molten coating bath about the emerging wire to be effectively flooded with the non-oxidizing wiping gas and temporarily protected from oxidation. In general the shorter any extension is on the lower portion of the wiping die or if there is no extension the more desirable it is to have the die closer to the coating bath surface.

Figure 4:
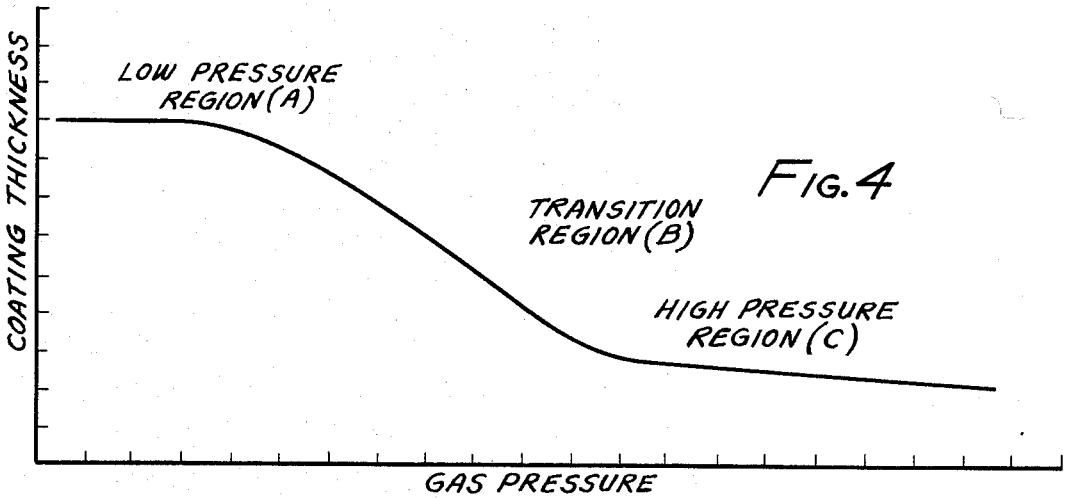
FIG. 4 is a curve illustrating the general relationship of gas wiping pressure to coating thickness in apparatus constructed in accordance with the invention.

In FIG. 4 there is shown a diagrammatic graph of the pressure effects upon wiping efficiency with the coating thickness obtained plotted against the gas pressure applied in the wiping die. The plot is approximate only and no precise or numerical relationship are intended to be shown. The horizontal sections of the curve designated "Low Pressure Region" (A) and "High Pressure Region" (C) respectively show regions in which the linear material is wiped and smoothed, but the weight of the applied coating is not effectively controlled by varying the pressure. The "Transition Region" (B) on the other hand, is a region in which variation of gas pressure results in varying thicknesses or weights of coating remaining upon the wire or other linear material. The exact slope and contour depends upon various factors. However, so long as the critical parameters of the present application are adhered to the general slope of the curve is maintained and the entire "Transition Region" or "Intermediate Region" can be used for control of the coating weight by adjustment only of the pressure of the wiping gas. The wiped coating also has very excellent concentricity with respect to the surface of the wire. While the exact reason for the improvement in wiping provided by the use of the critical parameters of the invention is not well understood at this time, it appears that the provision of the proper parameters and conditions decreases the slope of the transition region curve and thus in effect lengthens the region in which a change in gas pressure will result in a change in thickness. The relationship between the coating thickness and weight and the wiping gas pressure used is thus improved or made more controllable by decreasing the amount of change in the coating weight for any given change in wiping gas pressure. It is thought also that the relatively large throat and wiping orifices of the wiping die with respect to the other parameters of the die provides a relatively lower velocity gas wipe or a "softer" wipe than comparable wiping with other dies using the same relative gas pressures and that this may account for the excellent wiping control and good concentricity of the coating. At the present time this is only conjecture, however, and the Applicants do not wish to be held to any particular theory with respect to their excellent results which allow wire to be effectively wiped at speeds of from 100 to 600 or more feet per minute (33 to 200 meters per minute or more) with very excellent results.

While this invention has been illustrated and explained with reference to specific gas wiping equipment it should be understood that the critical parameters of the invention could also be used with other types of properly designed wiping equipment and that various wiping gases in addition to those specifically disclosed can be used.

We claim:

1. A gas wiping die for wiping linear material after initial passage of such material through a molten metal coating bath, comprising:

(a) a die body having a gas wiping orifice circumferentially surrounding a central throat through which the linear material passes, the gas wiping orifice being positioned from 1 to 15 inches above the surface of the molten metal bath, the throat diameter being from 0.50 to 1.50 inches, and (b) the gas wiping orifice having (1) an angle of about 10 to 45 degrees with respect to perpendicular to the surface of linear material passing through the die, (2) an orifice width of about 0.010 to 0.080 inch, and (3) substantially parallel side walls at least about 0.25 inch in length.

2. The gas wiping die of claim 1 wherein the orifice angle is about 15 to 30 degrees.

3. The gas wiping die of claim 1 wherein the orifice angle is about 20 to 25 degrees.

4. The gas wiping die of claim 1 in which the height of the gas wiping orifice of the die is approximately 0.5 to 10 inches above the surface of the coating bath.

5. The gas wiping die of claim 1 in which the height of the gas wiping orifice of the die is approximately 0.5 to 4 inches above the surface of the coating bath.

6. The gas wiping die of claim 1 wherein the throat diameter of the die is about 0.75 to 1.25 inches.

7. The gas wiping die of claim 1 wherein the orifice width parallel with the direction of movement of wire through the die is about 0.020 to 0.050 inch.

8. The gas wiping die of claim 1 wherein the orifice width parallel with the direction of movement of wire through the die is about 0.035 to 0.045 inch.

9. Apparatus for continuously applying and controlling the thickness of a metallic coating applied to the surface of wire material, including a molten metal coating bath from which said wire material issues, a source of pressurized non-oxidizing gas, and a gas wiping die disposed above said molten metal coating bath, comprising:

(a) a die body having a gas wiping orifice past which the wire material passes, the gas wiping orifice being positioned from 0.5 to 15 inches above the surface of said molten metal coating bath, said wiping die having a throat with a diameter of from 0.50 to 1.50 inches, and (b) said gas wiping orifice having (1) an angle of 10 to 45 degrees with respect to perpendicular to the surface of said wire material passing through the die, (2) a uniform opening having a width of 0.010 to 0.080 inch, and (3) substantially parallel side walls at least 0.25 inch in length.

10. The apparatus of claim 9 wherein the orifice angle is 15 to 30 degrees.

11. The apparatus of claim 9 wherein the orifice angle is 20 to 25 degrees.

12. The apparatus of claim 9 in which the height of the gas wiping orifice is approximately 0.5 to 10 inches above the surface of the coating bath.

13. The apparatus of claim 9 in which the height of the gas wiping orifice is approximately 0.5 to 4 inches above the surface of the coating bath.

14. The apparatus of claim 9 wherein the throat diameter of the wiping die is 0.75 to 1.25 inches.

15. The apparatus of claim 9 wherein the orifice width parallel with the direction of movement of wire through the wiping die is about 0.020 to 0.050 inch.

16. The apparatus of claim 9 wherein the orifice width parallel with the direction of movement of wire material through the wiping die is about 0.035 to 0.045 inch.

17. The apparatus of claim 9 additionally comprising a confined space between side walls positioned at the bottom of the die body and through which the wire passes at least partially between the coating bath and the gas wiping die.

18. A method of controlling the coating thickness on wire issuing from a molten coating bath comprising:

(a) passing said wire through a gas wiping die with a gas wiping orifice:
  (i) having a width of about 0.010 to 0.080 inch,
  (ii) curved sidewalls substantially parallel to each other not less than about 0.25 inch in length,
  (iii) downwardly inclined at an angle of about 10 to 45 degrees to perpendicular to the surface of wire passing through the die, and
  (iv) surrounding a central opening not less than 0.50 and not more than 1.50 inches in diameter through which the wire passes,
(b) wiping the molten coating on the wire by blowing a non-oxidizing gas through the gas wiping orifice onto the molten coating upon the wire while the wiping orifice is positioned from 0.5 to 15 inches above the surface of the molten coating bath, and
(c) controlling the coating thickness by changing the pressure of the non-oxidizing gas.

19. A method according to claim 18 wherein the non-oxidizing wiping gas is a heavy gas.

20. A method according to claims 18 or 19 wherein the wiping gas after contacting and wiping the surface of the molten coating on the wire is allowed to pass into a confined space surrounding the wire.

21. A method according to claims 18 or 19 wherein the angle of the gas wiping orifice is about 15 to 30 degrees.

22. A method according to claims 18 or 19 wherein the angle of the gas wiping orifice is about 20 to 25 degrees.

23. A method according to claims 18 or 19 wherein the height of the wiping orifice above the molten bath surface is about 0.5 to 10 inches.

24. A method according to claims 18 or 19 wherein the height of the wiping orifice above the molten bath surface is about 0.5 to 4 inches.

25. A method according to claims 18 or 19 wherein the throat diameter of the die is about 0.75 to 1.25 inches.

* * * * *